US008523482B1

(12) United States Patent
Watson, Sr.

(10) Patent No.: US 8,523,482 B1
(45) Date of Patent: Sep. 3, 2013

(54) ON DEMAND NON-RIGID UNDERWATER OIL AND GAS CONTAINMENT AND RETRIEVAL SYSTEM AND METHOD

(76) Inventor: Michael Ray Watson, Sr., Fort Lauderdale, FL (US)

( * ) Notice: Subject to any disclaimer, the term of this patent is extended or adjusted under 35 U.S.C. 154(b) by 111 days.

(21) Appl. No.: 13/348,853

(22) Filed: Jan. 12, 2012

Related U.S. Application Data

(63) Continuation-in-part of application No. 13/040,708, filed on Mar. 4, 2011, now abandoned.

(51) Int. Cl.
*E02B 15/04* (2006.01)

(52) U.S. Cl.
USPC ..... 405/60; 405/210

(58) Field of Classification Search
USPC ..... 405/60, 64, 210, 224–228; 114/256, 114/257; 166/364
See application file for complete search history.

(56) References Cited

U.S. PATENT DOCUMENTS

| | | | | |
|---|---|---|---|---|
| 3,500,841 | A | 3/1970 | Logan | |
| 3,548,605 | A | 12/1970 | Paull et al. | |
| 3,561,220 | A * | 2/1971 | Riester | 405/60 |
| 3,610,194 | A | 10/1971 | Siegel | |
| 3,653,215 | A * | 4/1972 | Crucet | 405/60 |
| 3,664,136 | A | 5/1972 | Laval, Jr. et al. | |
| 3,681,923 | A | 8/1972 | Hyde | |
| 3,724,662 | A | 4/1973 | Ortiz | |
| 3,745,773 | A | 7/1973 | Cunningham | |
| 3,824,942 | A | 7/1974 | Stafford et al. | |
| 3,981,154 | A | 9/1976 | Hix, Jr. | |
| 4,047,390 | A | 9/1977 | Boyce, II | |
| 4,358,218 | A | 11/1982 | Graham | |
| 4,373,834 | A * | 2/1983 | Grace | 405/60 |
| 4,405,258 | A | 9/1983 | O'Rourke et al. | |
| 4,531,860 | A | 7/1985 | Barnett | |
| 4,643,612 | A | 2/1987 | Bergeron | |
| 4,790,936 | A * | 12/1988 | Renfrow | 210/242.3 |
| 8,173,012 | B1 * | 5/2012 | Che | 210/170.05 |
| 2011/0274496 | A1 * | 11/2011 | Dvorak | 405/64 |

* cited by examiner

*Primary Examiner* — Sean Andrish
*Assistant Examiner* — Kyle Armstrong
(74) *Attorney, Agent, or Firm* — Malin Haley DiMaggio & Bowen, P.A.

(57) ABSTRACT

An underwater oil and gas containment and retrieval system comprising a collapsible deployable oil and gas containment canopy including a dome comprised of several separately stored dome panels (1), a discharge vent tube (2) including inflatable air chambers (14) to provide some rigidity and shape, dome panel storage containers (3) for storing the dome panels (1) on the ocean floor, and a separate discharge vent tube storage container (16) for storing the discharge vent tube separately on the ocean floor. The system is especially useful for deep water wells below 500 feet deep.

5 Claims, 9 Drawing Sheets

ON DEMAND NON-RIGID UNDERWATER OIL AND GAS CONTAINMENT AND RETRIEVAL SYSTEM AND METHOD

CROSS REFERENCE TO RELATED APPLICATIONS

This application is a continuation-in-part of co-pending U.S. patent application Ser. No. 13/040,708, filed Mar. 4, 2011.

BACKGROUND OF THE INVENTION

1. Field of the Invention

This invention relates to a system to contain and retrieve oil and gas from a deep water well that has developed uncontrollable discharge. Specifically, the invention describes a non-rigid containment and retrieval system stored surrounding the well on the ocean floor in such a manner that it does not interfere with drilling or production activities and that can be activated at the time of the well failure on demand for immediate protection of the environment from deep water discharged oil and gas.

2. Description of the Prior Art

In May 2010 there was a disastrous deepwater oil well failure in the Gulf of Mexico that caused great damage to the environment because of the sheer volume of discharged oil that could not be contained for several months. Because deep water oil and gas wells are submerged under water, often below 500 feet, the water pressure is so great that human beings cannot reach the depths to fix a broken well. There are thousands and thousands of deepwater oil wells throughout the world. Each deepwater oil well is a disaster waiting to happen, even if the well is no longer in service.

There are numerous devices and systems that have been described in the literature, including prior issued U.S. patents that deal with containment and retrieval of uncontrollably discharged oil and gas from deep water wells. One common problem with these systems is that the recovery systems are not stored at the well site or in position at the well before the oil well failure. Therefore, there is a significant amount of time required to install at the well site any one of these systems in order to start containing and retrieving discharged oil. Unfortunately, based on the discharge rates possible by broken oil wells, millions of gallons of polluting oil can have already been discharged before any of these systems could be realistically put in operating position. An example of a prior U.S. patent showing a system is U.S. Pat. No. 3,664,136, issued May 23, 1972. In this device, the containment devices installed are conical in shape and are used to contain and retrieve oil after the well has ruptured. There is no provision for storing this device permanently surrounding the oil well site on the bottom of the ocean for instant deployment. Another example of a prior U.S. Patent showing a system is U.S. Pat. No. 3,548,605 filed Dec. 22, 1970. In this device the system is a mobile apparatus adapted to be lowered to an underwater location. Although the device could be stored nearby, its design would not allow it to be stored surrounding the well in place and it would need to be moved into place when needed. It included a one piece fluid gathering funnel shaped collector and a canopy (discharge vent tube) in sections. This device may include a cover (dome) to collect gases. However this dome is of one solid piece and is positioned at the surface of the water, not at the bottom at the site of the leaking well. The discharge vent tube in this device is provided shape by rings as opposed to the air chambers in the instant device.

The Applicant's invention described herein will be installed at a well site surrounding the well before the well is damaged. The system can be deployed on demand on a moment's notice at the damaged oil well site on the bottom of the ocean at the time of the rupture remotely from the ocean surface from the oil rig itself. By having an on demand deployment, the oil spill rupture can be contained and retrieved virtually immediately, thus allowing the system to protect the environment against millions and millions of gallons of oil that could have been discharged while trying to bring in or position containment devices known in the prior art.

SUMMARY OF THE INVENTION

An underwater oil and gas containment and retrieval system comprising a collapsible deployable oil and gas containment canopy comprised of several non-rigid panels pulled together from the top to form a completed dome (1), an oil and gas discharge vent tube (2), dome panel storage containers (3) for storing the dome panels on the ocean floor, a discharge vent tube storage container (16) for storing the discharge vent tube separately on the ocean floor, a discharge vent tube float (4) and cable (17), a dome panel float (5) connected to a dome panel float cable system (9) a system deployment operating system that is remotely activated from above the water surface connected to the floats (4) and (5), and a plurality of anchors imbedded to the bottom of the ocean near the well to be protected. The system is especially useful for deep water wells below 500 feet deep.

The deployable canopy dome panels (1) are comprised of flexible non-rigid materials which, when pulled up from the top by cables (9) connected to the dome panel float (5) form a completed dome which is essentially sealed due to the overlap (13) of the dome panels (1), and which is used to trap oil or gas discharged from the well (11). The dome is used in conjunction with a collapsible discharge vent tube (2) connected at the very top of the dome and extendable up to the ocean surface for directing the contained oil and gas up to the surface of the ocean where it can be harvested by a recovery vessel. The dome is constructed of several individual flexible panels (1) made of non-rigid rubber-based material or synthetic fibers that can be folded and stored on the ocean floor in a large area comprising a circle around the outside area of the oil well. The size of the base of the dome is determined by the specifics of the oil rig and can be as large as a football field or even larger.

The dome is comprised of a plurality of flexible triangularly shaped dome panels (1) that have a larger base than length. The dome panels (1) are overlapped shown by dotted line (13) when deployed as a dome. The dome panels (1) can be folded up and stored on the ocean floor in sections inside the dome panel storage containers (3) in a circle outside the diameter of the well when the system is installed on the ocean floor and remain in storage like an air bag in a car until deployment because of a damaged and leaking well.

The oil recovery system includes a discharge vent tube (2) which functions like a pipe to direct discharged oil and gas from the top area of the dome upwardly to the surface of the ocean. Thus, the vent tube extends to the ocean surface, once deployed with the dome system. The discharge vent tube (2) is flexible for storage purposes and made of a non-rigid material identical to that used for the dome panels. The discharge vent tube, when deployed, has its base connected to the top of the dome ring (6) by the discharge vent tube bottom ring (7).

On deployment the discharge vent tube (2) is initially activated by opening the discharge vent tube storage container (16) and inflating the discharge vent tube float (4) by remote control from the surface. The discharge vent tube float (4) brings the top of the discharge vent tube to the surface. When fully deployed the bottom of the discharge vent tube (2) will be suspended above the ocean floor at approximately the height of the fully deployed dome. The dome ring (6) is drawn up to meet the discharge vent tube bottom ring (7) by the discharge vent tube cables (18) and cable winches (19) drawing up the dome ring connecting cables (18) which are attached to the dome ring. Since the water depth of the well is known, the discharge vent tube (2) can be preconstructed to a specific length before installation.

In order for the non-rigid discharge vent tube (2) to maintain the shape of a tube after deployment, the fabric of the tube will be formed into air chambers (14), similar to the air chambers in a swimming pool float, which will be inflated by gases after deployment to provide some rigidity and shape for the discharge vent tube.

The dome panels (1) are deployed after the discharge vent tube (2) is fully deployed and the dome ring (6) is drawn up by cables (5) to connect to the discharge vent tube bottom ring (7) by inflating the dome panel float (5) which is also stored on the ocean floor. The dome panel float (5) is connected to the dome panel float cable system (9) which is attached to the dome panels (1) as stored and folded up on the ocean floor. When the dome panels are deployed by the dome panel float (5) and dome panel cable system (9), the dome panel sections (1) are pulled upwardly by the dome panel float cable system (9) attached to the dome panel float (5). The dome panel float cables (9) each has a separate cable connected to the top of each dome panel. When the dome panel floats (5) are each inflated remotely by gases and floats upward, the dome panel floats (5) pull each of the cables (9) and all the individual panels (1) up from the canopy storage units to form an essentially sealed dome. The individual cables (9) are pulled through the dome ring cable guides (20) so that the dome panels (1) are pulled up tight against the dome ring (6) to form the completed dome. The panels are triangular sheets of flexible material which are folded for storage on the ocean floor inside the dome panel storage containers (3) similar to the way sails on a sailboat are folded when not in use. Each panel (1) is positioned to overlap dotted line (13) the adjoining panel along each side sufficiently to eliminate leakage or diminish leakage from the dome of the oil trapped therein. The upward force of the float to rise, plus the upward pressure of the contained oil and/or gas on the inside of the dome, will press the sides of the flaps together to form a closed barrier. Additional side edge fasteners such as hook and pile fasteners known under the trademark VELCRO can be used on the inside of each of the flaps to provide a better seal, if necessary.

The device uses the upward pressure of the dome panel floats (5) plus the upward pressure of the escaping oil and gas discharged (11) to keep the dome panels (1) properly deployed. The dome panel anchor system comprising cables (8) and winches with reels (15) allow for distributing the entire recovery dome centered over the well and high enough above the sea floor, if necessary, to diminish oil pressure inside the dome. The cables, winches and reels (15) which are connected to the dome panel anchor system (12) can be remotely operated from the surface to reel in or reel out the dome panel anchor cables (8) connected to the bottom of the dome panels (1) to keep the bottom of the dome panels (1) at the proper height above the sea floor. Oil and gas are lighter than seawater and inclined to float to the surface of the ocean. The bottom portion of the dome will contain seawater. The dome is lifted by the dome panel float (5) from the seafloor allowing the pressure under the dome to be controlled.

The system deployment activating equipment is positioned on the ocean floor adjacent to the stored discharge vent tube storage container. The system can receive RF signals from a remote location above the water such as a floating oil rig that will cause the oil recovery system to be deployed. The activating equipment may include a radio controlled device which is used to inflate the floats with gases when the device receives a remote signal from the ocean surface.

Because there will be forces from undersea currents as well as upward pressure from the discharged oil and gas (11) that act on the dome panels (1) when containing oil and gas that has been discharged from a ruptured oil well, it is essential that the entire system, which is stored underwater at the oil well site, be securely anchored to the ocean floor. Various anchor systems can be used depending on the circumstances. For example, in a sandy bottom an auger or corkscrew type anchor system may be adequate. For a solid sea floor a plurality of anchor pilings may be used.

It is an object of this invention to provide a non-rigid underwater oil and gas containment and retrieval system that is stored on the ocean floor in close proximity to and surrounding the oil well drilling or production operations in such a manner as to not interfere with drilling or production activities but to be in place so that it may be activated on a moment's notice in the event of a catastrophic leak.

It is another object of this invention to provide a non-rigid discharge vent tube (2) which can be folded and stored separately on the sea floor outside the dome panel storage containers in such a manner as to not interfere with drilling or production activities but to be in place so that it may be activated on a moment's notice in the event of a catastrophic leak.

It is another object of this invention to provide a system for connecting the discharge vent tube (2) to the top of the containment and retrieval system dome to provide a means for the discharged gas and oil (11) to be directed to the surface for harvesting and to prevent damage to the environment from the leak.

It is another object of this invention to provide a means to provide some rigidity to the discharge vent tube (2) after deployment through the use of air chambers (14) inflated by gases so that the discharge vent tube (2) retains its shape while in use.

It is another object of this invention to provide an underwater oil and gas retrieval system that can be activated remotely from the surface on a moment's notice when a catastrophic leak occurs without the necessity of first moving the device or other equipment.

DETAILED DESCRIPTION OF THE INVENTION

Figure 1:
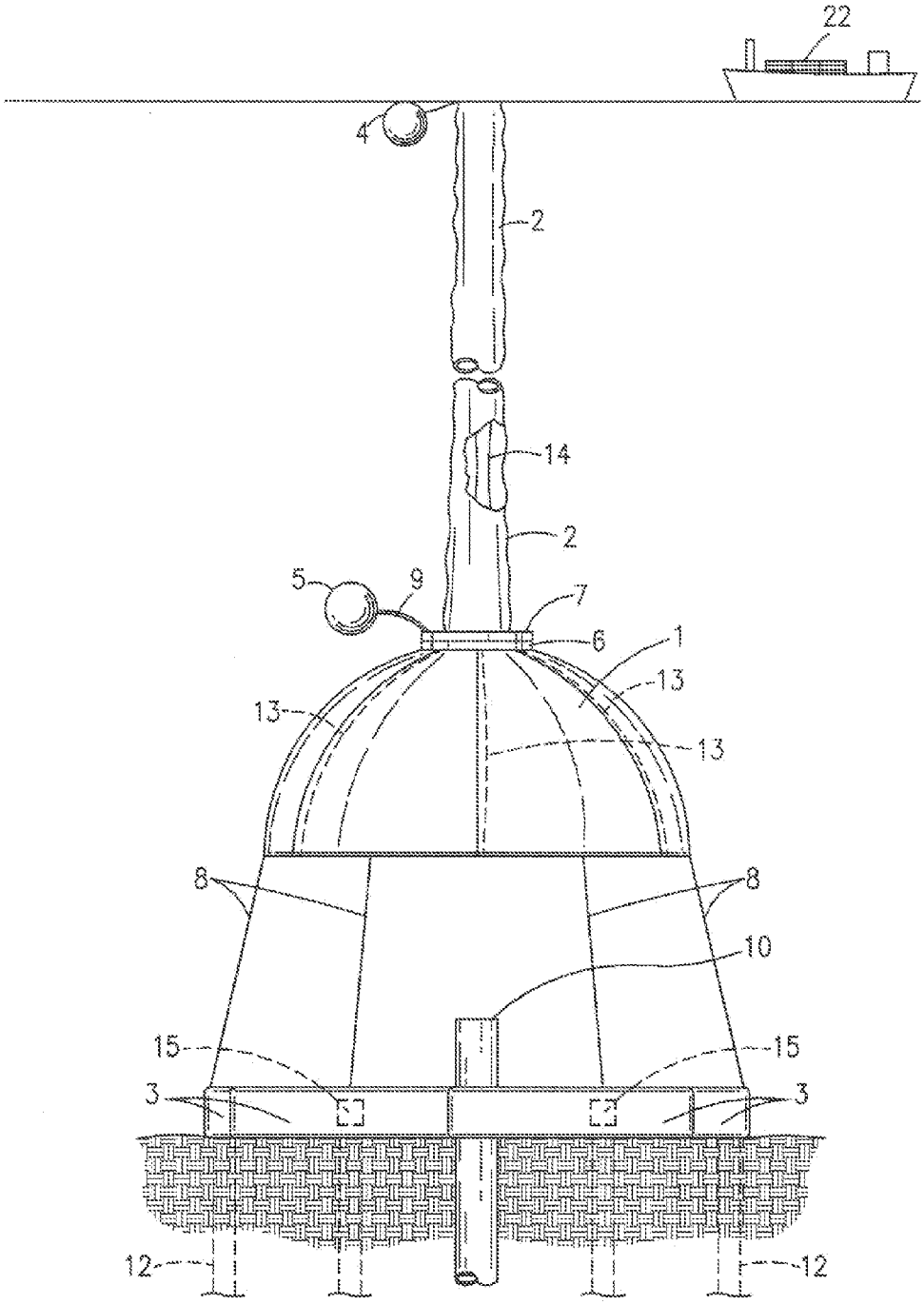
FIG. 1 shows a side elevational view of the system after deployment.
Figure 2:
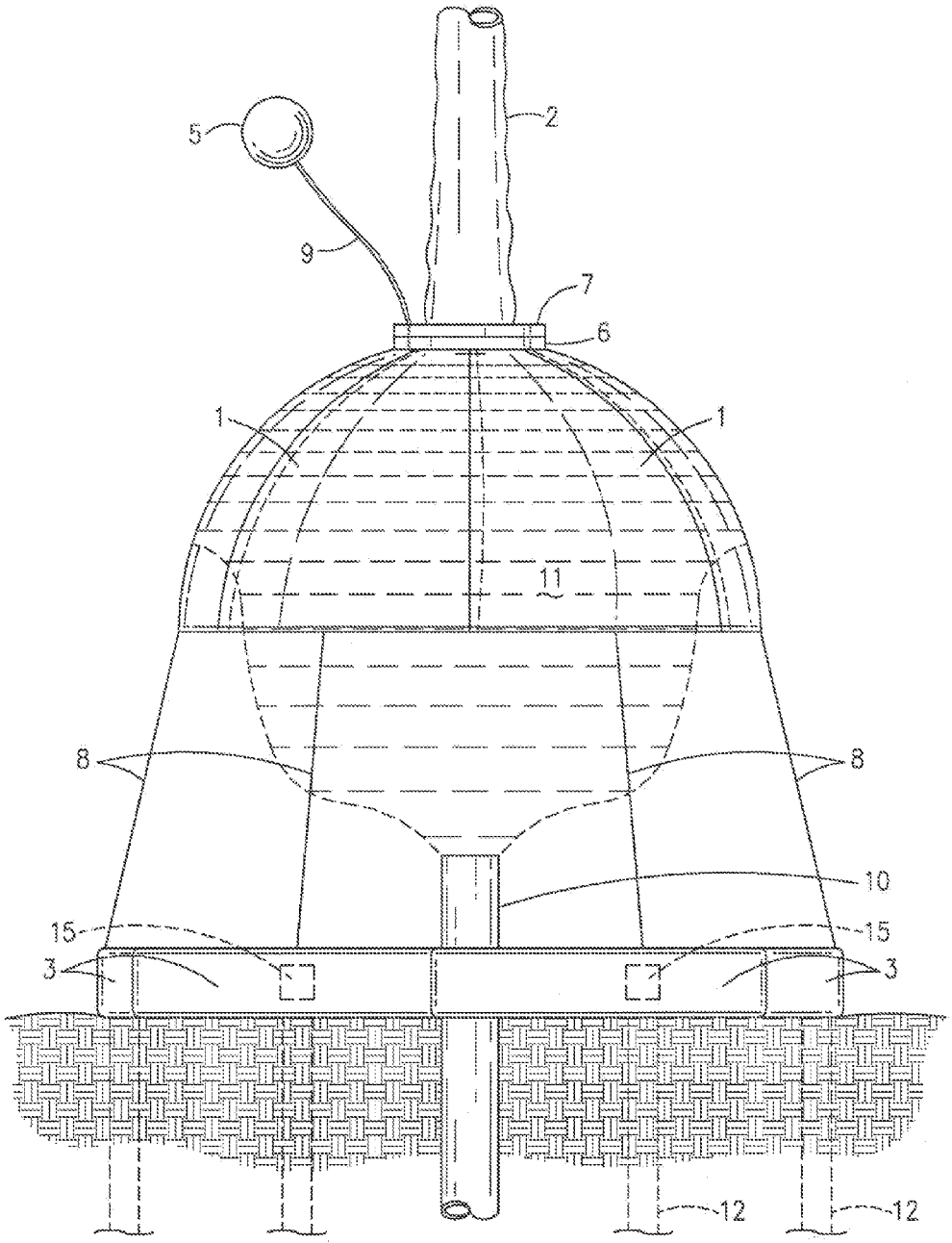
FIG. 2 shows a side elevational view of the canopy filled with oil and gas discharge after the system has been deployed.
Figure 3:
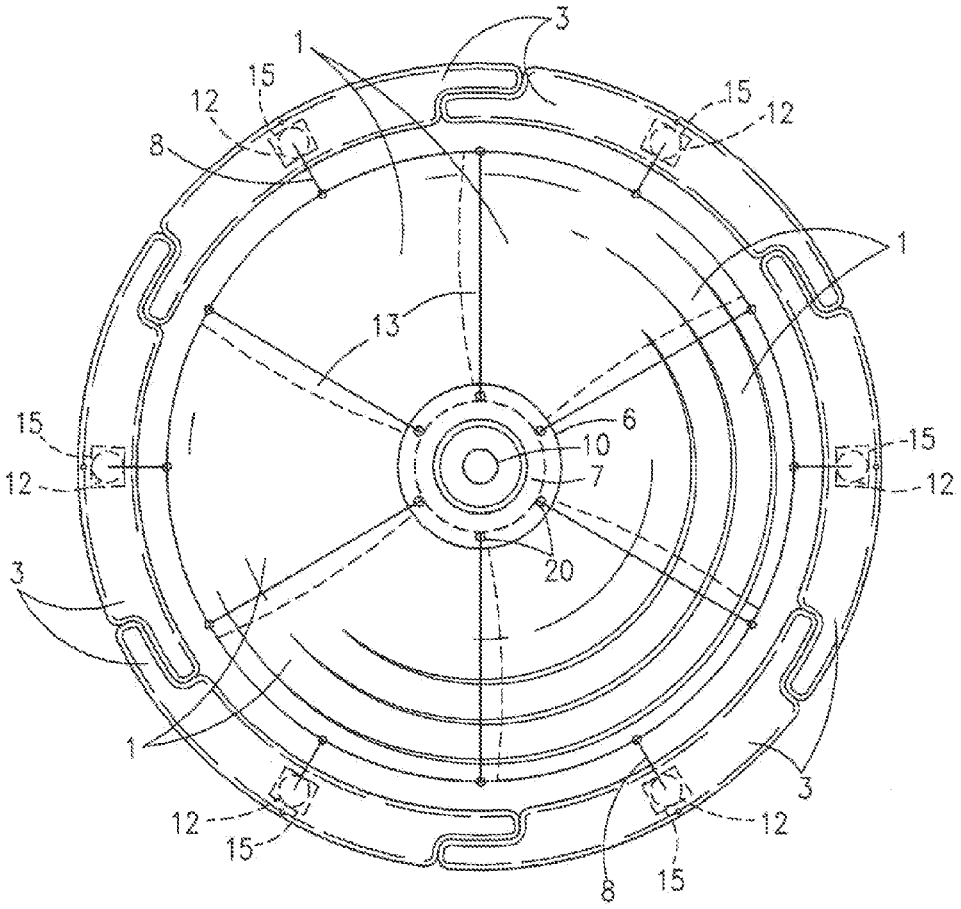
FIG. 3 shows a top plan view of the system after deployment.
Figure 4A:
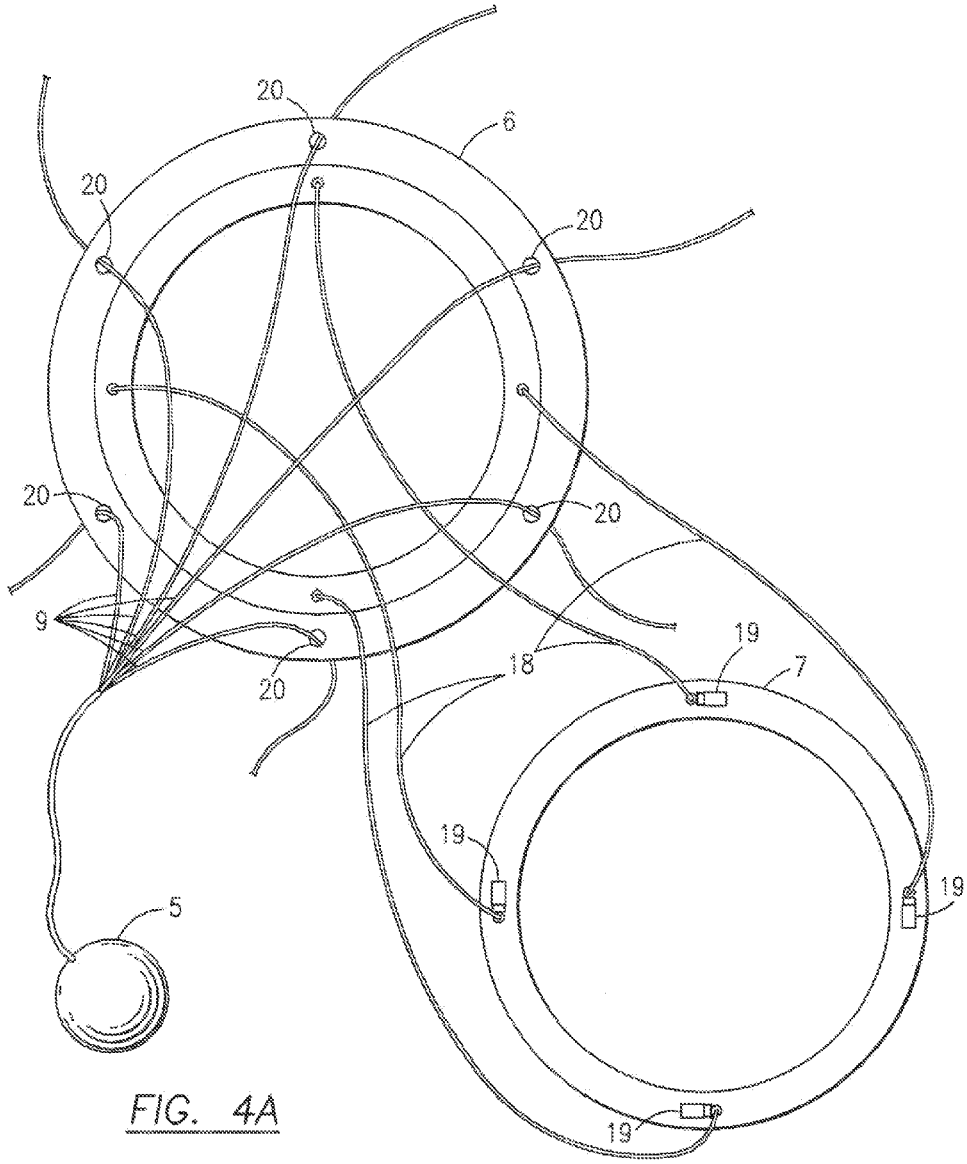
FIG. 4A shows a top view of the dome ring (6), the dome panel float (5) and dome panel float cable system (9) and the discharge vent tube bottom ring (7) and the dome ring connecting cables (18) that connect the dome ring (6) to the discharge vent tube bottom ring (7).
Figure 4B:
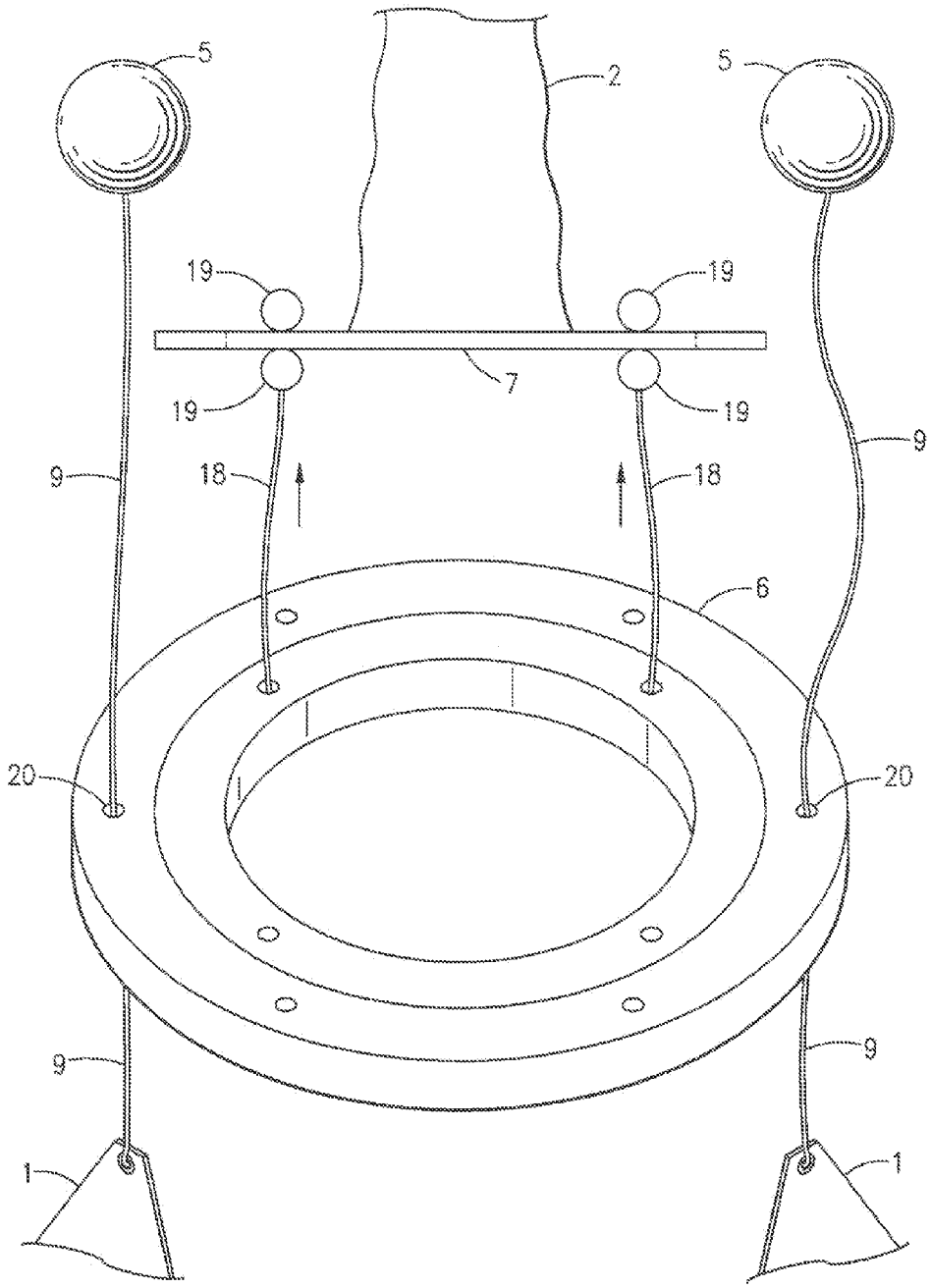
FIG. 4B shows a perspective view partially cut away of the discharge vent tube bottom ring (7) and its attachment to the dome ring (6).

FIG. 1, FIG. 2, and FIG. 3 show the containment and retrieval system deployed in order to capture oil and gas (11) that is being discharged from disabled well shaft (10). In order to deploy the system, a RF signal is first sent from the surface recovery vessel or rig (22) to the discharge vent tube storage container (16) (FIG. 6) to open the container (16) followed by a RF signal to the discharge vent tube float (4) to release gases to inflate the discharge vent tube float (4) so that the float (4) rises to the surface bringing the discharge vent tube (2) and top with the float (4). A third RF signal is sent to the gas container cartridges (21) (FIG. 7A) in the air chambers (14) to inflate the air chambers in the discharge vent tube (2) to provide some rigidity and shape for the discharge vent tube (2). Next a RF signal is sent to activate the discharge vent tube cable winches and reels (19) to draw the dome ring (6) up tight against the discharge vent tube bottom ring (7) (FIGS. 4A and 4B). Lastly, a RF signal is sent to the dome panel floats (5) to inflate the floats with gases so that the dome panel floats (5) draw the dome panels (1) up tight against the dome ring (6) to form the essentially sealed dome.

FIG. 1 shows a side elevational view of the system after deployment. This view demonstrates the discharge vent tube (2) having a top opening, and the discharge vent tube float (4) after deployment as well as the dome panel (1), dome panel float cable system (9), and dome panel float (5) after deployment. It also demonstrates the dome ring (6) connected to the discharge vent tube bottom ring (7), the dome panel overlap dotted line (13), the discharge vent tube air chambers (14), the dome panel anchor system (12), the dome panel storage containers (3) and the dome panel anchor system and reels (15) connected to anchor cables (8). Pipe (10) represents the disabled well shaft discharge pipe.

FIG. 2 shows a side elevational view of the canopy comprised of the dome panels (1), the dome panel overlap dotted lines (13), the discharge vent tube (2), discharge vent tube air chambers (14), the dome panel float (5) the dome panel anchor cables (8), the dome panel storage containers (3), the dome panel anchor system winches and reels (15), and the dome panel anchor system pilings (12) after the system has been deployed.

In FIG. 1, the dome panels (1) are shown after being raised up by float (5) and cables (5) deployed and overlapping to form a complete, essentially sealed dome. The top of the dome is formed by dome ring (6) connected to the vent tube bottom ring (7) at the bottom of the discharge vent tube (2). The top of the discharge vent tube is raised to the ocean surface by the discharge vent tube float (4). The bottom of the dome panels (1) are fastened to the dome panel anchor system (12) which includes dome panel anchor cables (8) and the dome panel cable winches and reels (19). The panels (1) can be remotely controlled to allow the bottom of the dome panels (1) to be raised or lowered by cables (8) to the appropriate height above the sea floor so that the dome is high enough to diminish the pressure of the escaping gas and oil and low enough to capture essentially all of the escaping gas and oil (11). Note that the discharge vent tube top opening has been deployed all the way to the surface of the ocean as shown in FIG. 1. With the discharge tube vent (2) extended to the ocean surface and the dome fully deployed with all of the panels (1) in place, the system is able to contain and retrieve oil and gas discharge (11) as shown in FIGS. 1 and 2 at the ocean surface.

FIG. 3 shows a top plan view of the system after deployment. This view demonstrates the dome panel anchor system (12) beneath the dome panel storage containers (3), the deployed dome panels (1), the dome panel overlap dotted lines (13), the dome ring (6) connected to the discharge vent tube bottom ring (7) and the well shaft (10).

Figure 6:
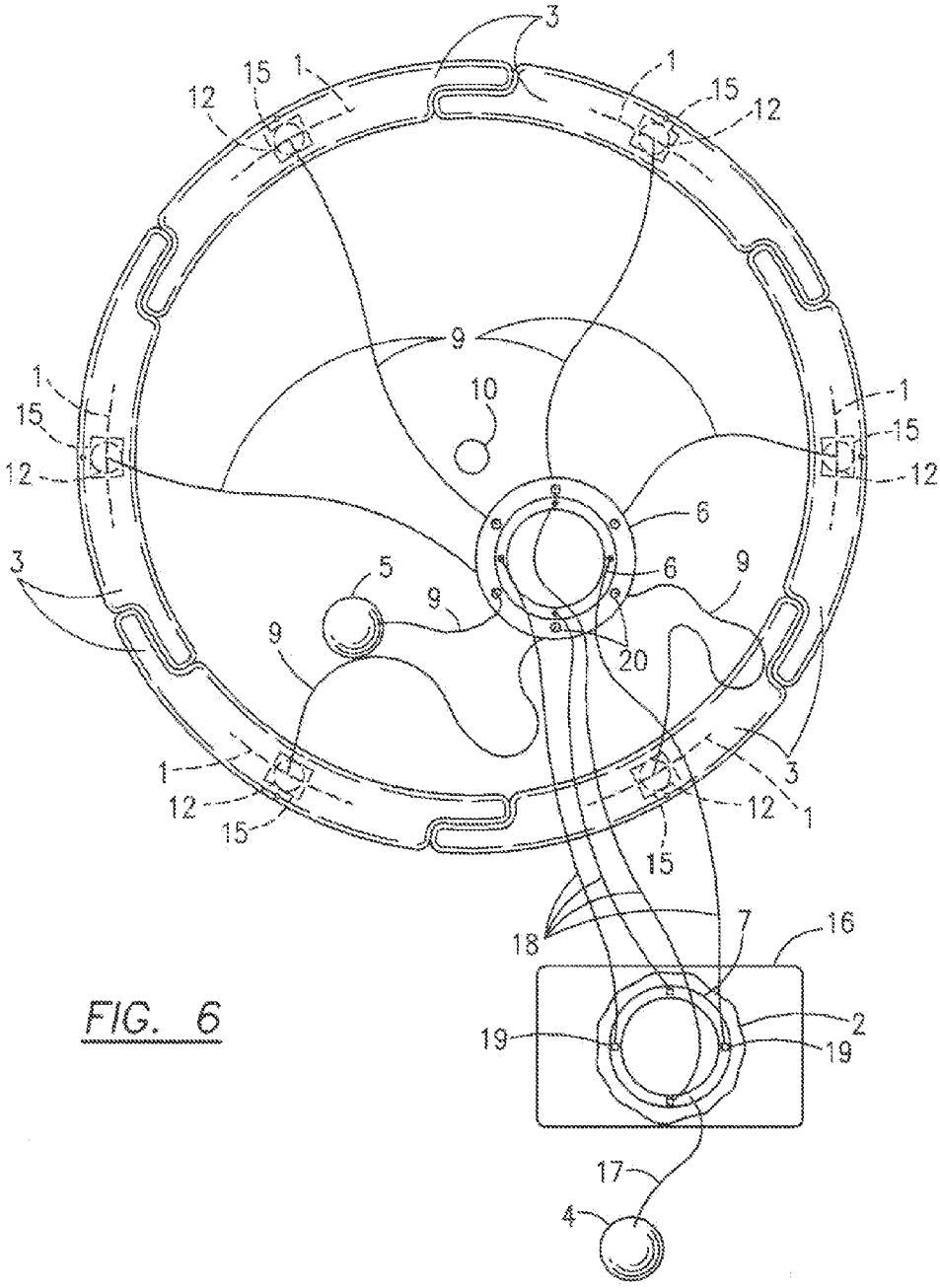
FIG. 6 shows a top plan view of the system in place before deployment on the ocean floor in a storage position prior to activation.

FIGS. 1, 2, 3 and 8 show the dome panel anchor cables (8) connected to the dome panel anchor system winches and reels (15). In addition to the dome, FIGS. 1, 2 and 7A and 7B show the discharge vent tube (2) as well as the inflated discharge vent tube air chambers (14). The disabled well shaft (10) can be a capped well head, a producing well head or an active drilling operation. In FIG. 6, note that the dome panel storage containers (3), which are shown surrounding the well shaft (10) are spaced far enough away from the well shaft (10) so as to not interfere with the operation of the well. Note also that the dome panel storage containers (3) are stored so that the container bodies overlap in order to provide the dome panel overlap at the bottom of the dome. The disposition of the containment and retrieval system is shown in FIG. 6 in the storage mode.

Referring now to FIGS. 4A and 4B, the cable and rings used for connecting the bottom of the discharge vent tube (2) after deployment to the top of the dome panels (1) after deployment are shown. The discharge vent tube bottom ring (7) is suspended above the ocean floor once the discharge vent tube (2) is fully deployed. The inside diameter of the dome ring (6) and the discharge vent tube bottom ring (7) are drawn together during deployment of the system so that the discharged oil and gas contained by the panels (1) passes from the dome panels (1) to the vent tube (2). The vent tube bottom ring (7) is loosely connected to the dome ring (6) and the discharge vent tube cable winches and reels (19) by the dome ring connecting cables (18). After the discharge vent tube (2) is fully deployed, the discharge vent tube cable winches (19) are activated remotely from the surface to reel in the dome ring connecting cables (18) and draw the dome ring (6) up tight against the discharge vent tube bottom ring (7). FIG. 4B also illustrates the dome panel float cables (5) which deploy the panels (1) that are connected on one end to the top of the dome panels (1), being drawn through the dome ring (6) through the dome ring cable guides (20) and connected to the dome panel float (5) on the other end. When float (5) is activated causing the float (5) to rise upwardly with buoyancy force, cables (9) are pulled upwardly along with the top of each panel (1), thus forming the dome.

Figure 5:
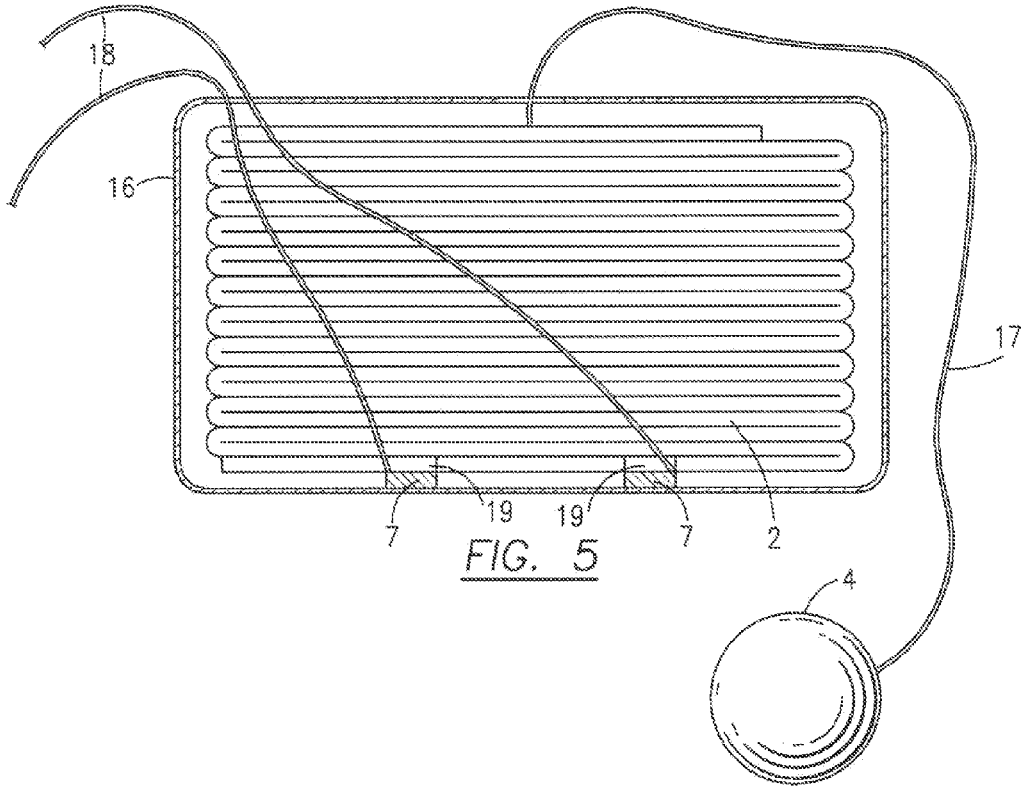
FIG. 5 shows a side elevational view partially in cross-section showing the discharge vent tube storage container (16) with the discharge vent tube (2) stored inside with the discharge vent tube bottom ring (7) and the float (4) stored outside.

FIG. 5 shows a side elevational view in cross-section of the discharge vent tube storage container (16) with the discharge vent tube (2) folded and stored inside. FIG. 5 also shows the discharge vent tube float cable (17) attached near the top of the discharge vent tube (2) and the discharge vent tube float (4). In addition, FIG. 5 shows the discharge vent tube bottom ring (7) stored at the bottom of the discharge vent tube (2) and the dome ring connecting cables (18).

FIG. 5 also shows the discharge vent tube (2) being stored inside the protective sealed discharge vent tube storage container (16) before deployment. The discharge vent tube float (4) once activated by an RF signal releasing its contents by pressure becomes very buoyant forcing the float (4) upward and opening the top cover on container (16). The float (4) pulls cable (17) connected to the top of the discharge vent tube (2) upwardly deploying the discharge vent tube (2). It also shows the discharge vent tube bottom ring (7) in the stored position at the bottom of the discharge vent tube (2) connected to the dome ring connecting cables (18) which are also attached to the dome ring (6).

FIG. 6 shows a top plan view of the system in place before deployment as the system rests on the ocean floor in a storage position prior to activation. This view shows the dome panel storage containers (3) disposed away from but around a well shaft (10) which could be a working well or a capped well. Note that the system is far enough from well shaft (10) to not interfere in the operation of the well. The distance from the dome panel storage containers (3) to well shaft (10) can be hundreds of yards. The dome panel storage containers (3) are positioned in an overlapping circular relationship on the sea floor. The dome panel float cables (9) on the sea floor before deployment connect through the dome ring (6) and to the dome panel float (5) deflated on the sea floor, and the dome ring cable guides (20). The discharge vent tube storage container (16) is positioned outside of the array of the dome panel storage containers (3). The discharge vent tube (2) is folded and stored inside the discharge vent tube storage container (16). The discharge vent tube float (4) is stored outside the discharge vent tube storage container (16) and is connected to the discharge vent tube float cable (17). The discharge vent tube bottom ring (7) is connected to the bottom of the discharge vent tube (2). The dome ring connecting cables (18) are connected to the dome ring (6) and the discharge vent tube cable winches and reels (19).

In FIG. 6, all of the dome panels (1) that ultimately will comprise the containment and retrieval dome are folded and stored in the dome panel storage containers (3) surrounding the well and anchored to the ocean floor by pilings (12).

The bottom edges of the dome panels (1) that form the dome are connected to reels and winches 15 by cables (8) that can raise or lower the distance of the panels (1) to the ocean floor after deployment.

Figure 7A:
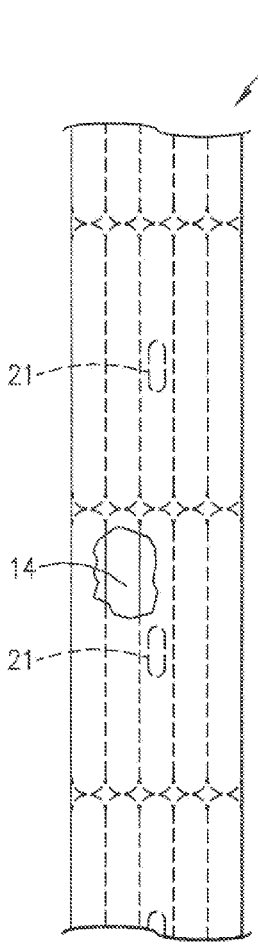
FIG. 7A shows a side elevational view partially cut away of the discharge vent tube deployed.
Figure 7B:
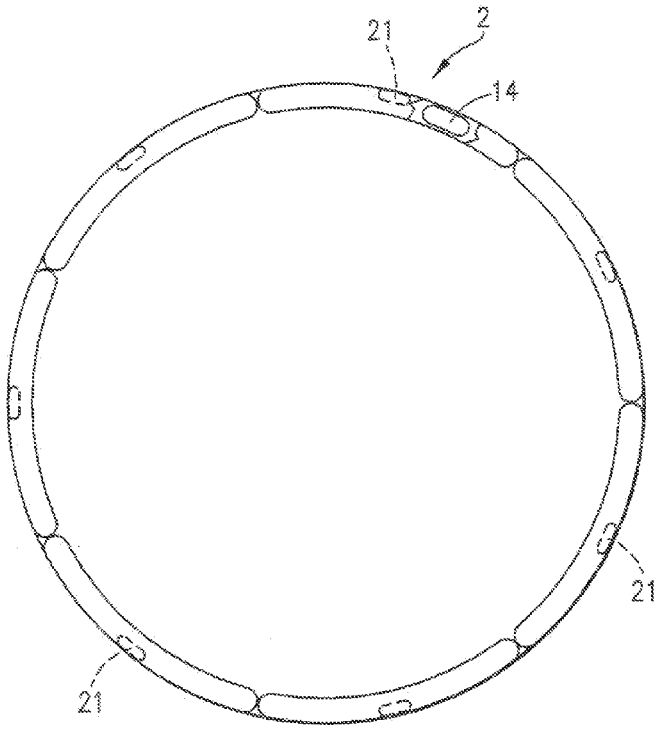
FIG. 7B shows a top plan view in cross-section of the fully deployed discharge vent tube (2) including the air chambers (14) and the gas cartridges (21) used for inflation.

Referring now to FIGS. 7A and 7B, the fully deployed discharge vent tube (2) is shown in a side view and a top view. These views show the air chambers (14) which are remotely inflated using gas cartridges (21). Because of undersea currents pushing against the side of the discharge vent tube (2) there would be a tendency for the discharge vent tube (2) to collapse and not provide a free flow of gas and oil to the surface. Once inflated, the air chambers making up the discharge vent tube (2) will provide some rigidity and shape so that the discharge vent tube (2) remains open while in use.

Figure 8:
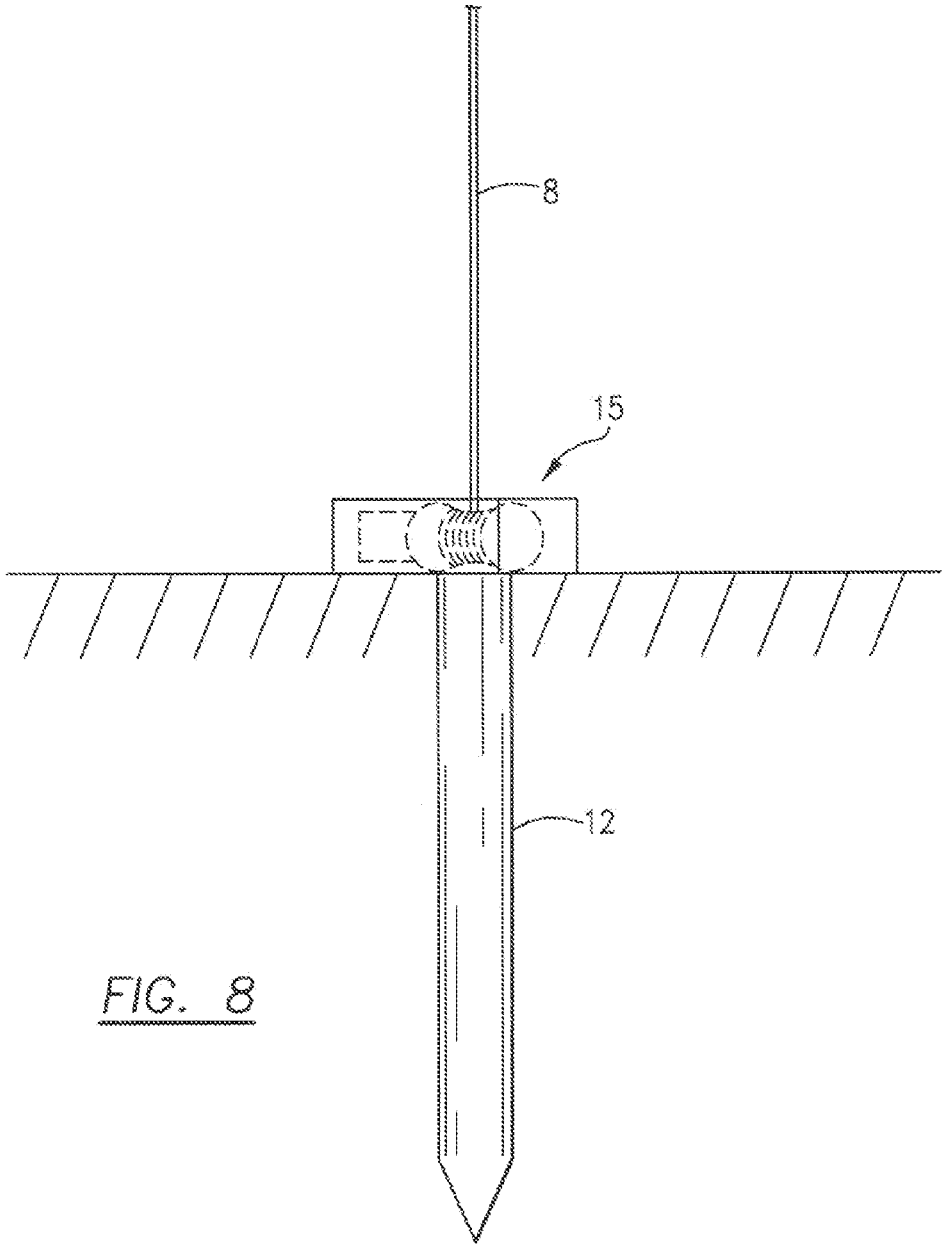
FIG. 8 shows a side elevational view of the dome panel anchor system (12), the dome panel anchor cables (8) and the dome panel anchor system winch and reels (15) mounted on the ocean floor.

Referring now to FIG. 8, the dome panel anchor system uses a piling (12) driven in the ocean floor connected to winches and reels (15) that attach to cables (8) that are attached to the bottom of panels (1) to stop the panels at a specific distance above the ocean floor. Various anchor methods may be used with cables to secure the entire containment and retrieval system to the ocean floor surrounding the well to be protected. The number of anchors necessary will be a direct function of the size of the dome panel storage containers needed to form a complete ring around the well, the amount of ballast or flotation forces on these units when deployed and the water depth which will increase the buoyancy force necessary to deploy the system. The dome panel anchor system winches and reels (15) are utilized to remotely control the height of the bottom of the completed dome over the well site. The winches (15) can reel out the dome panel (1) anchor cables (8) to raise the bottom of the dome panels (1) so that the pressure of the escaping gas and oil (11) does not affect the functionality of the dome. The winches (15) can also reel in the dome panel (1) anchor cables (8) so that the bottom of the dome panels (1) are low enough to capture all of the escaping gas and oil.

OPERATIONAL SEQUENCE

1. The oil containment system will be stored in place on the sea floor surrounding the capped well shaft (10) but located far enough away from the well so as not to interfere with the well cap. It will remain in place until needed as shown in FIG. 6.

2. Once it is determined that the leak is significant enough to require deployment of the system, a worker in a ship on the surface will send a remote RF signal to begin deployment (FIG. 1).

3. The discharge vent tube storage container (16) FIG. 5 and the dome panel storage containers (3) will open remotely. Another RF signal will be sent from the surface to inflate the discharge vent tube float (4) which will draw the discharge vent tube (2) up to the surface. See FIG. 1.

4. When the discharge vent tube (2) is fully deployed, a RF signal will be sent from the surface to inflate the discharge vent tube air chambers (14), using gas cartridges (21) attached to the inside of each chamber, to provide some rigidity and shape to the discharge vent tube (2).

5. When the discharge vent tube (2) is fully deployed the discharge vent tube bottom ring (7) will be suspended above the sea floor at about the height of the fully deployed dome. A remote RF signal will be sent from the surface to activate the discharge vent tube cable winches and reel (19), thereby drawing the dome ring (6) up to connect to the discharge vent tube bottom ring (7).

6. The dome panel storage containers (3), which overlap and are connected together to form a complete circle when stored in place on the sea floor, will be opened at the same time the discharge vent tube storage container (16) is opened FIG. 1.

7. The dome panel float (5) will be inflated remotely and will float up bringing the dome panels (1) up tight against the dome ring using the dome panel float cables (9) which are connected to the top of the dome panels. The dome panels (1) are designed to overlap when fully deployed to minimize leakage through the panels. In instances where significant pressures are anticipated, hook and pile fasteners known under the trademark VELCRO may be used at the overlapped sides dotted lines (13) to further minimize leakage. FIGS. 1 and 2.

8. The bottom of the dome can be raised or lowered as necessary to the proper depth to capture the maximum amount of oil and gas and control pressures inside the dome by utilizing the dome panel anchor cables (8) in conjunction with the dome panel anchor system winches and reels (15) FIG. 8.

9. The recovery ship will connect to the top of the discharge vent tube (2) to recover the oil and gas as gas and oil come to the surface. FIG. 1.

10. Operation on operating wells will be the same as for non-operating wells except that the discharge piping connected to the surface will need to be removed before deploying the device.

The following is a list of parts and elements used in the specification and drawings:

1. Dome panels
2. Discharge vent tube
3. Dome panel storage containers

4. Discharge vent tube float
5. Dome panel float
6. Dome ring
7. Discharge vent tube bottom ring
8. Dome panel anchor cables
9. Dome panel float cable system
10. Well shaft
11. Oil and gas discharge
12. Dome panel anchor system
13. Dome panel overlap
14. Discharge vent tube air chambers
15. Dome panel anchor system winches and reels
16. Discharge vent tube storage container
17. Discharge vent tube float cable
18. Dome ring connecting cables
19. Discharge vent tube cable winches and reels
20. Dome ring cable guides
21. Gas cartridges The instant invention has been shown and described herein in what is considered to be the most practical and preferred embodiment. The applicant recognizes, however, that departures may be made therefrom within the scope of the invention and that obvious modifications will occur to a person skilled in the art.

What is claimed:

1. An underwater oil and gas containment and retrieval system comprising:

a collapsible, deployable oil and gas containment canopy forming a dome, said dome including a plurality of separately-stored dome panels (1), said dome having a top opening;

a dome panel float for raising and deploying said dome panels from a stored position to a dome shaped position;

a discharge vent tube (2) having inflatable air chambers (14) to provide rigidity and shape for deploying said discharge vent tube from a stored position to an extended vertical position with the top opening at the ocean surface;

dome panel storage containers (3) for storing the dome panels (1) on the ocean floor having a top opening and a bottom opening;

a discharge vent tube storage container (16) for storing the discharge vent tube (2) separately on the ocean floor;

a discharge vent tube bottom ring (7) connected to the bottom opening of said vent tube;

a dome ring (6) connected to the top opening of said dome panels;

means for connecting the discharge vent tube (2) bottom opening to the top of the dome panels (1) utilizing the discharge vent tube bottom ring (7), the dome ring (6), said means including dome ring connecting cables (18) and discharge vent tube cable winches and reels (19), said means for connecting remotely activated from above the water surface; and one or more anchors for anchoring the dome panels to the bottom of the ocean surrounding the well to be protected.

2. An oil and gas retrieval system as in claim 1, wherein:

the dome is made up of several individual flexible non-rigid panels (1) used to trap oil, the dome being used in conjunction with said collapsible vent tube mounted at the very top of the dome and extendable up to the ocean surface for directing the contained oil and gas up to the surface of the ocean, said panels (1) are made of non-rigid rubber based material that is folded and stored on the ocean floor in a large area around an outside area of the oil well, whereas said system is useful for deep water wells below 500 feet deep.

3. A system as in claim 2, including:

the non-rigid collapsible discharge vent tube (2) that is folded and stored in place on the sea floor until needed due to an uncontrollable gas and oil leak, that is deployed remotely from the surface, and that includes air chambers (14) that are remotely inflated with gases from a gas cartridge to provide some rigidity and shape after deployment.

4. A system as in claim 2, for connecting the top of the dome (panel) (1) to the bottom of the discharge vent tube (2) by utilizing the dome ring connecting cables (18) and the discharge vent tube cable winches and reels (19).

5. The method according to the apparatus of claim 1 of containing and retrieving oil and gas from a deep water well that is leaking gas or oil uncontrollably comprising the steps of:

a) placing an oil containment system stored in place on the sea floor surrounding a capped well shaft (10) but located far enough away from the well so as not to interfere with the well cap;

b) determining that a well leak is significant enough to require deployment of the system, and sending a remote radio frequency (RF) signal to begin deployment by opening said discharge vent tube storage container (16) and the dome panel storage containers (3);

c) sending a second RF signal from the surface to inflate a discharge vent tube float (4) drawing the discharge vent tube (2) up to the surface;

d) after the discharge vent tube (2) is fully deployed, sending a RF signal from the surface to inflate the discharge vent tube air chambers (14), using gas cartridges (21) attached to the inside of each chamber, to provide some rigidity and shape to the discharge vent tube (2);

e) after the discharge vent tube (2) is fully deployed, the discharge vent tube bottom ring (7) being suspended above the sea floor at about a height of the fully deployed dome, sending a remote RF signal from the surface to activate the discharge vent tube cable winches and reel (19);

f) drawing the dome ring (6) up to connect to the discharge vent tube bottom ring (7);

g) opening the dome panel storage containers (3), which overlap and are connected together to form a complete circle when stored in place on the sea floor, at the same time the discharge vent tube storage container (16) is opened;

h) sending a signal to inflate the dome panel float (5) and to raise the dome panels (1) up tight against the dome ring using dome panel float cables (9) which are connected to the top of the dome panels;

i) adjusting the bottom of the dome by raising or lowering as necessary to the proper depth to capture the maximum amount of oil and gas and control pressures inside the dome by utilizing dome panel anchor cables (8) in conjunction with dome panel anchor system winches and reels (15); and j) recovering gas and oil leaking from said well through the discharge vent tube (2).

* * * * *